175-48 SR
7/1/80 XR 4,210,208

United States Patent [19]
Shanks

[11] 4,210,208
[45] Jul. 1, 1980

[54] SUBSEA CHOKE AND RISER PRESSURE EQUALIZATION SYSTEM

[75] Inventor: Forrest E. Shanks, DeSota, Tex.

[73] Assignee: Sedco, Inc., Dallas, Tex.

[21] Appl. No.: 966,091

[22] Filed: Dec. 4, 1978

[51] Int. Cl.[2] ..... E21B 7/12
[52] U.S. Cl. ..... 166/352; 166/367; 175/7; 175/48
[58] Field of Search ..... 166/350, 358, 367, 345, 166/352, 359; 175/72, 7, 5, 25, 38, 48, 71

[56] References Cited

U.S. PATENT DOCUMENTS

| | | | |
|---|---|---|---|
| 3,189,098 | 6/1965 | Haeber | 175/7 X |
| 3,354,951 | 11/1967 | Savage et al. | 166/345 X |
| 3,434,550 | 3/1969 | Townsend | 175/72 |
| 3,815,673 | 6/1974 | Bruce et al. | 175/25 X |
| 3,889,747 | 6/1975 | Regan et al. | 175/7 X |
| 3,955,411 | 5/1976 | Lawson, Jr. | 175/7 X |
| 4,046,191 | 9/1977 | Neath | 175/25 X |
| 4,060,140 | 11/1977 | Barrington | 175/7 |
| 4,063,602 | 12/1977 | Howell et al. | 175/48 |

*Primary Examiner*—Ernest R. Purser
*Assistant Examiner*—Richard E. Favreau
*Attorney, Agent, or Firm*—Hubbard, Thurman, Turner, Tucker & Glaser

[57] ABSTRACT

Method and apparatus for controlling down hole pressure during an offshore drilling operation is disclosed. The method and apparatus are particularly useful for drilling in deep water from an offshore surface facility which includes a drilling vessel stationed above an ocean floor drilling site in which well head equipment is embedded. A marine riser is connected to the well head equipment and extends to the drilling vessel. A drill string enclosed within the riser extends from the drilling vessel through the well head equipment and into a borehole beneath the ocean floor. Choke and kill conduit lines are connected in fluid communication with the borehole and extend from the well head equipment to the drilling vessel. According to the invention, a subsea choke valve is connected in fluid communication with the choke conduit line and with the interior of the riser whereby fluid or gas may be discharged at a controlled rate from the choke line directly into the riser annulus. Closure of the choke valve is controlled from the surface in order to maintain the down hole pressure exerted by the gases and fluids of the subterranean formation substantially in equilibrium with the hydrostatic head of the column of drilling mud contained within the riser annulus. In a preferred embodiment, the subsea choke valve apparatus mounted on the lowermost riser section which is coupled to the well head equipment.

16 Claims, 5 Drawing Figures

SUBSEA CHOKE AND RISER PRESSURE EQUALIZATION SYSTEM

BACKGROUND OF THE INVENTION

1. Field of the Invention

The present invention relates generally to deep sea drilling equipment and in particular to the construction and operation of a riser mounted subsea choke valve for well control.

2. Description of the Prior Art

The search for offshore deposits of crude oil and natural gas is being extended into deeper and deeper waters beyond the continental shelf. Drilling operations in deeper waters are carried out from floating vessels rather than from bottom-founded drilling platforms commonly used in shallow water. According to conventional procedures, a drilling vessel is dynamically stationed above a well site on the ocean floor. After a well head has been established, a blowout preventer (BOP) stack is mounted on top of the casing of the well as a means for controlling the pressures which may arise at the surface opening of the well. A drill string is extended from the floating vessel to the bottom of the well through the well head equipment on the ocean floor. The drill string is enclosed within a riser pipe which is attached to the well head equipment and which is supported under tension at the water surface to prevent its collapse. Drilling mud is circulated through the drill string and is returned through the riser annulus which surrounds the drill pipe.

The drilling mud serves several important functions during the drilling process. One important function of the drilling mud is the provision of lubrication and heat transfer as it is discharged through the rotary drill bit. Additionally, the drilling mud dislodges and carries away drill bit cuttings from the drill bit as it is returned through the annulus of the riser.

Another important function of the drilling mud is that it serves as a fluid seal for well control purposes. Well control is established by maintaining the density of the drilling fluid and thus the hydrostatic pressure exerted on the subsurface formations at a level which is sufficient to control infiltration of fluid from the formation into the drilling mud. If the density of the drilling mud is too light, gas or other formation fluids may infiltrate the drilling mud which causes the drilling mud to become progressively lighter above the drilling zone. If uncontrolled, the infiltration of formation fluids into the drilling mud can lead to a blowout and fire, frequently causing loss of life, damage to property and pollution of the ocean.

On the other hand, if the density of the drilling fluid becomes too heavy, it is possible that the hydrostatic pressure of the drilling fluid in the return column can become great enough to cause the drilling fluid to infiltrate the formation and create a condition known as lost circulation. With lost circulation, the hydrostatic pressure of the drilling fluid can decrease below the pressure of the formation and cause a blowout. Furthermore, if the density becomes too heavy, it is possible that the resulting pressure gradient of the column of drilling fluid may exceed the natural fracture gradient of the formation and thereby propagate a fracture through the formation as lost circulation occurs.

According to conventional practice, choke and kill conduit lines are extended from the drilling vessel to the well head equipment to provide for well control. The kill line is used primarily to control the density of the drilling mud. One method of controlling the density of the drilling mud is by the injection of relatively lighter drilling fluid through the kill line into the bottom of the riser to decrease the density of the drilling mud. On the other hand, if it is desired to increase density, a heavier drilling mud is injected through the kill line. Because the drill cuttings are conveyed in the drilling mud returned through the riser, a small degree of control of mud density may be exercised by increasing or decreasing the rate of drilling penetration.

Although the foregoing procedures are effective for establishing fundamental hydrostatic pressure levels, because of the amount of time required to implement these procedures, it is sometimes not possible to accommodate the different pressure levels which may suddenly arise as the drilling operation traverses different formations having unequal pressures. Because of large concentrations of gas, the pressure of the new formation may greatly exceed the hydrostatic pressure of the column of drilling mud in the riser annulus. Well control has been exercised in this situation by means of a choke conduit line which extends from the well head equipment to the drilling vessel. The choke conduit line is connected in fluid communication with the borehole at the well head in order to bypass the riser and vent gases or other formation fluids directly to the surface. According to conventional practice, a surface mounted choke valve is connected to the terminal end of the choke conduit line whereby the down hole back pressure can be maintained substantially in equilibrium with the hydrostatic pressure of the column of drilling fluid in the riser annulus by adjusting the discharge rate through the choke conduit.

The foregoing arrangement has proven to be effective and satisfactory for controlling down hole pressures when drilling in relatively shallow waters. However, because of the small diameter of the choke conduit, the pressure drop along the choke conduit becomes greater and greater as the length of conduit line increases. Therefore, as the search for offshore deposits of crude oil and natural gas is extended into deeper and deeper waters, the effectiveness of the surface choke valve diminishes because of the increasing pressure drop along the choke conduit line, and well control becomes increasingly more difficult.

SUMMARY OF THE INVENTION

According to the invention, a subsea choke valve is connected in fluid communication with the choke conduit line and with the interior of the riser whereby fluid or gas may be discharged at a controlled rate from the choke line directly into the riser annulus. The cross-sectional area of the riser is substantially larger than the cross-sectional area of the choke conduit and therefore presents substantially less resistance to fluid flow as compared to a corresponding length of choke conduit. The subsea choke valve is preferably connected very close to the well head equipment thereby minimizing the pressure drop and increasing the effectiveness of the choke. The high pressure fluid or gas is discharged from the subsea choke into the riser rather than into the surrounding ocean to prevent a dangerous accumulation of gas around the drilling vessel and also to prevent pollution of the seaway. Closure of the choke valve is controlled from the surface in order to maintain the down hole pressure exerted by the gases and fluids of the subterranean formation substantially in equilibrium with the hydrostatic head of the column of drilling fluid contained within the riser annulus.

In a preferred embodiment, the subsea choke valve apparatus is mounted on the lowermost riser section which is coupled to the well head equipment. A gate valve connects the inlet port of the choke valve to the choke conduit. Both the gate valve and the choke valve are remotely hydraulically actuated. The choke conduit line operates in the conventional manner when the gate valve is closed. However, when the terminal end of the choke conduit is sealed and the gate valve is opened, high pressure gas or fluid is discharged from the choke conduit line through the gate valve and into the choke valve. Discharge through the choke valve is remotely regulated at the surface by a signal which controls a hydraulic actuator which is coupled to the choke valve.

A discharge conduit connects the output of the choke valve to the interior of the riser. It is preferred that the flow path through the discharge conduit have a cross-sectional area which gradually increases from the choke to the riser in order to reduce the velocity of the fluid or gas as much as possible before it enters the riser. Additionally, the discharge conduit is preferably arranged to discharge the formation fluid or gas in a direction opposite to the upward flow of drilling fluid through the riser in order to reduce the velocity of the drilling fluid as it is displaced through the riser.

Under certain conditions a large volume of high pressure gas may be discharged in combination with other formation fluid through the choke conduit. When this occurs, the gas is discharged into the annulus of the riser and expands as the drilling mud is displaced. It is possible that the drilling mud from the riser will be evacuated along a substantial length of the riser which can cause the riser to collapse because of the pressure differential. This condition is corrected according to the invention by means of a pressure equalization valve assembly which when opened permits sea water to fill the voided annulus of the riser, thereby equalizing the pressure of the interior of the riser relative to the exterior of the riser. In addition, the pressure equalization valve may be opened when desired to permit drilling fluid to be discharged into the surrounding ocean rather than being recirculated through the riser and drill string.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DETAILED DESCRIPTION

Figure 1:
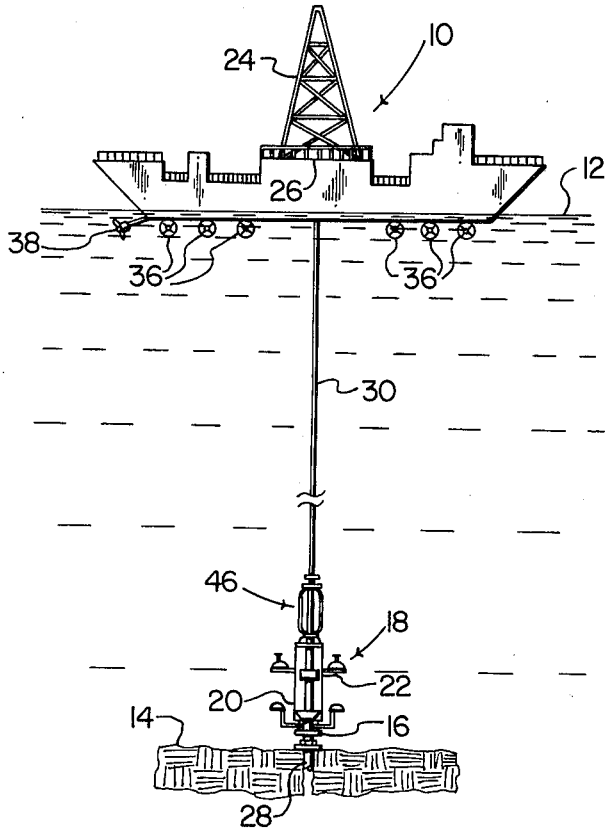
FIG. 1 is a simplified elevational view, partly in section, of a drilling vessel which is dynamically stationed above an ocean floor production site in which well head equipment is embedded.

In the description which follows, like parts are marked throughout the specification and in all figures of the drawing with the same reference numerals respectively.

Referring now to FIG. 1, an offshore drilling vessel 10 is dynamically stationed in a body of water 12 above a drilling or production site 14 in which conventional well head equipment 16 is embedded. Mounted on the well head equipment 16 is a conventional blowout preventer (BOP) 18 having lower and upper stack sections 20 and 22, respectively.

The offshore drilling vessel 10 is equipped with a conventional drilling derrick 24 which is mounted above a moon pool opening (not shown) formed in a central part of the ship. Supported intermediate the moon pool and the derrick is a pipe handling platform 26 which includes a conventional rotary table (not shown). A drill string 28 is suspended from the drilling derrick 24 and is coupled to the rotary table by conventional coupling apparatus (not shown). The drill string 28 is enclosed within a marine riser string 30 which is connected at its lower end to the BOP 18. The lower end of the drill string 28 extends through the well head equipment 16 into a borehole 32 through which it advances toward a subsurface formation as the drill string 28 is rotated within the riser 30. Drilling fluid or mud is pumped down through the center of the drill string 28 to a rotary drill bit (not shown) at the bottom of the well bore and is circulated through the riser annulus as it is returned to the drilling vessel 10. Drill cuttings entrained in the drilling mud are removed at the surface after which the drilling mud is recirculated through the drill string 28.

The offshore drilling vessel 10 is equipped with a number of transverse thrusters 36 in addition to main propulsion screws 38 which cooperate to dynamically position the drilling vessel 10 above the production site 14. The thrusters are positioned to provide the best ship movement capability so the ship can always head into the worst environmental conditions.

According to conventional practice, the upper end of the riser 30 is coupled to the rotary table by means of a telescopic slip joint (not shown) which permits heaving of the drilling vessel relative to the upper end of the riser 30. Because the riser string 30 cannot withstand compression loading, a lifting force is applied to its upper end by a tensioner assembly to induce tension loading in the riser to prevent its collapse.

Figure 2:
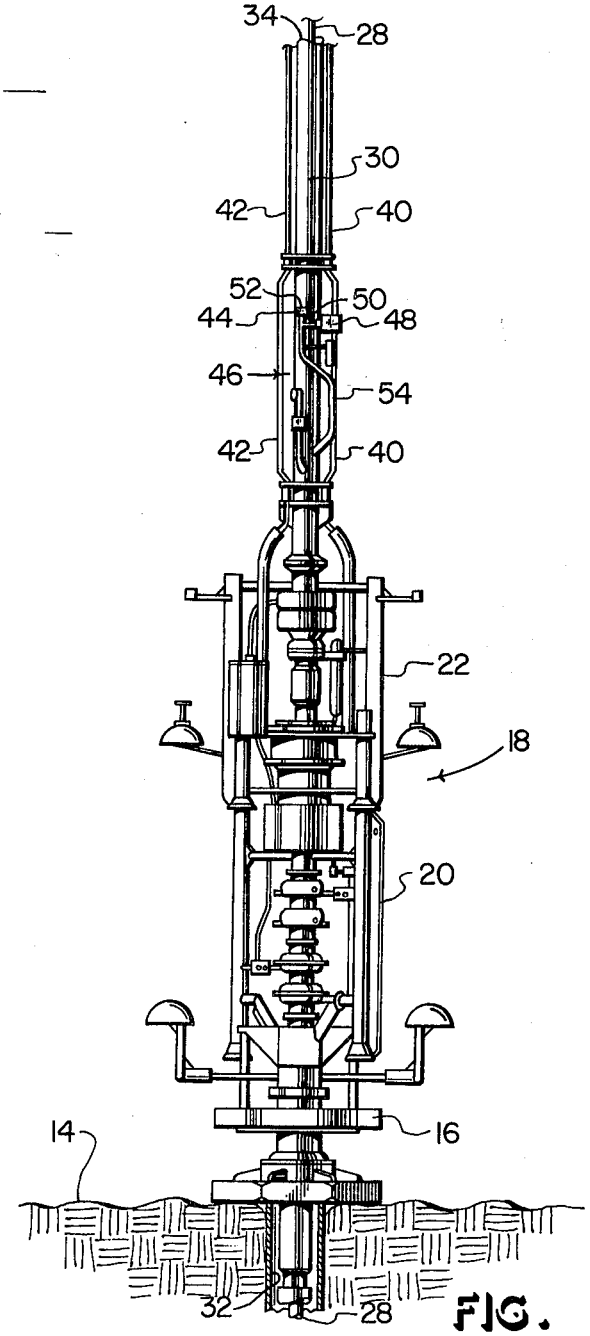
FIG. 2 is an elevation view, partly in section, of a portion of the well head equipment shown in FIG. 1.

Referring now to FIGS. 1 and 2, choke and kill conduit lines 40, 42 are suspended from the drilling vessel 10 to the well head equipment 16 to provide for well control. The choke and kill conduit lines are connected in fluid communication with the borehole 32 at the well head 16. The choke conduit line 40 provides a bypass for venting gases or other formation fluids directly to the surface. The kill line 42 is used primarily to control the density of the drilling mud in the borehole. According to conventional practice, relatively lighter drilling fluid is injected through the kill line 42 into the borehole to decrease the density of the drilling fluid. Alternatively, if it is desired to increase density, a heavier drilling mud is injected through the kill line. Both lines may be used for either purpose when biased properly.

The choke and kill lines are coupled in fluid communication with the well head equipment 16 by means of male/female stab joints (not shown) which include automatic seals. The BOP 18 includes ram type preventers which are hydraulically actuated. Electrical power and pressurized hydraulic fluid are supplied by means of an armor covered umbilical (not shown) which supplies power and control signals from the drilling vessel to the BOP equipment. Data is transmitted back to the vessel 10 in the conventional manner. Control signals, power and data signals are received and transmitted between the vessel and the subsea control equipment on the BOP at a control panel carried aboard the drilling vessel 10. The control signals and data signals can be utilized to monitor changes which indicate the flow of formation fluids into the borehole 32 or infiltration of drilling fluid into the subterranean formation.

In the course of drilling operations an emergency may arise which makes it necessary to use the shear rams of the blowout preventer 18 to obtain a complete shutoff of the borehole 32. Typical situations arising which may require this operation are when a blowout occurs through the drilling string and all conventional methods of control fail; when in a floating drilling operation the anchoring system fails to hold the drilling vessel in a position over the hole; and where severance of the drill string is the only quick action to insure a safe withdrawal of the vessel from the drilling or production site in case of sudden, adverse weather conditions. This type of well control is utilized only in the event of extreme emergencies.

The more conventional type of well control with which this application is concerned is the use of the drilling mud to contain the formation fluids and gases which are encountered during the drilling procedure. This type of well control is established by maintaining the density of the drilling fluid and thus the hydrostatic pressure exerted on the subsurface formations at a level which is sufficient to prevent infiltration of fluid from the formation into the drilling mud. If the density of the drilling mud is too light, gas or other formation fluids may infiltrate the drilling mud which causes the drilling mud to become progressively lighter above the drilling zone. If uncontrolled, the infiltration of formation fluids into the drilling mud can lead to a blowout. On the other hand, if the density of the drilling fluid becomes too heavy, it is possible that the hydrostatic pressure of the drilling fluid in the return column can become great enough to cause the drilling fluid to infiltrate the formation and create a lost circulation condition. With lost circulation, the hydrostatic pressure of the drilling fluid can decrease below the pressure of the formation and cause a blowout. Furthermore, if the density becomes too heavy it is possible that the resulting pressure gradient of the column of drilling fluid may exceed the natural fracture gradient of the formation and thereby propagate a fracture through the formation as lost circulation occurs.

The kill line 42 has been used successfully for maintaining a fundamental level of hydrostatic pressure by changing the density of the drilling mud. Well control has also been exercised by means of the choke conduit line 40 which extends from the well head equipment 16 to the drilling vessel 10 for venting high pressure gas or formation fluids directly to the surface. According to conventional practice, a surface mounted choke valve (not shown) carried on the offshore drilling vessel 10 is connected to the terminal end of the choke conduit line 40 whereby the down hole back pressure is maintained substantially in equilibrium with the hydrostatic pressure of the column of drilling fluid in the riser annulus 34 by adjusting the discharge rate through the choke valve. However, as the length of the choke line 40 increases, there is a corresponding increasing pressure drop along the choke conduit line so that the effectiveness of the surface choke valve diminishes and well control becomes increasingly more difficult to achieve.

According to the invention, a subsea choke valve 44 is connected in fluid communication with the choke conduit line 40 and with the riser annulus 34 whereby high pressure formation fluid or gas may be discharged at a controlled rate from the choke line directly into the riser annulus. The subsea choke valve 44 is preferably connected very close to the well head equipment thereby minimizing the pressure drop and increasing the effectiveness of the choke. As can be seen in FIG. 2, the subsea choke valve 44 is mounted on the lowermost riser section 46 which is coupled to the upper BOP stack 22. The high pressure formation fluid or gas is discharged from the subsea choke valve 44 into the riser annulus 34 rather than into the surrounding ocean to prevent a dangerous accumulation of gas around the drilling vessel and also to prevent unnecessary pollution of the seaway.

Closure of the choke valve 44 is controlled from the surface through the umbilical in order to maintain the down hole pressure exerted by the gases and fluids of the subterranean formation substantially in equilibrium with the hydrostatic head of the column of drilling fluid contained within the riser annulus. A gate valve 48 connects the inlet port 50 of the choke valve in fluid communication with the choke conduit line 40. Both the gate valve 48 and choke valve 44 are remotely hydraulically actuated. According to a preferred method of operating this apparatus, the choke conduit line 40 is operated in the conventional manner when the gate valve 48 is closed. However, when the terminal end of the choke conduit line 40 is sealed and the gate valve 48 is opened, high pressure gas or fluid is discharged from the choke conduit line through the gate valve 48 and into the choke valve 44. Discharge through the choke valve 44 is remotely reguated at the surface by a signal which controls a hydraulic actuator 52 which is coupled to the choke valve. Hydraulic supply fluid and electrical signal lines may be conveniently "jumpered up" from the main stack supply and control system to control pods mounted on the lowermost riser section 46. Alternatively, an auxiliary umbilical carrying electrical power, data lines and hydraulic power may be provided.

A discharge conduit 54 connects the output of the choke valve 44 to the annulus 34 of the lowermost riser section 46. According to a preferred embodiment, the flow path through the discharge conduit 54 presents a cross-sectional area which gradually increases from the choke valve to the riser annulus in order to reduce the velocity of the fluid or gas as much as possible before it enters the riser. Additionally, the discharge conduit 54 is preferably arranged to discharge the formation fluid or gas in a direction opposite to the upward flow of drilling fluid through the riser in order to reduce the velocity of the drilling fluid as it is displaced through the riser.

Figure 3:
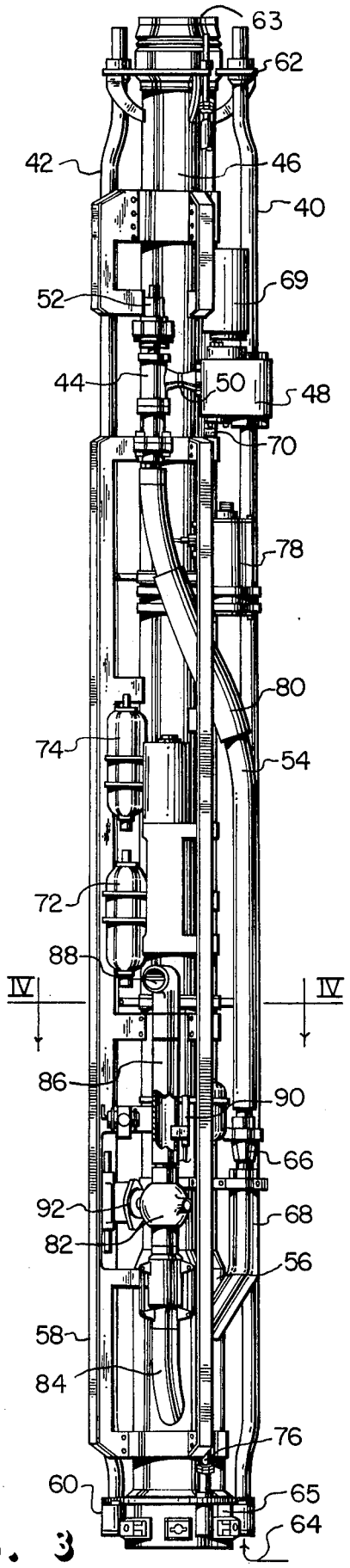
FIG. 3 is an elevation view of a riser mounted subsea choke and pressure equalization system of the invention.

Referring now to FIG. 3, the construction of the choke assembly 44 of the invention is shown in detail. As previously discussed, the choke assembly 44 is mounted on the first riser joint directly above the flex joint of the BOP stack, or as close as is practical. The lowermost riser section 46 is somewhat shorter in length as compared to an ordinary riser section and will be referred to herein as a "pup" joint. Although only one choke assembly is illustrated, it should be understood that an identical subsea choke assembly is mounted on the opposite side of the riser section 46 for connection to the kill line 42. The equipment on the opposite side of the riser is arranged in mirror image relation with respect to the apparatus as shown in FIG. 3. Therefore one subsea choke assembly is connected in fluid communication with the choke line 40 while the subsea choke assembly on the opposite side is connected into fluid communication with the kill line 42. Each of the subsea choke assemblies has a discharge opening into the riser.

The pup joint 46 shown in FIG. 3 resembles a typical riser joint with the exception of an extra thick wall section 56 located at the lower end of the joint. This thicker section contains four openings of which two are choke access openings and two are pressure equalization openings which will be explained in detail hereinafter. The purpose of the extra thickness on the lower end of the pup joint 46 is to insure that fatigue resistance is as good as other members of the riser system. Four protective bumpers 58 are attached to the pup joint 46 to protect the subsea choke valve apparatus as it is lowered through the rotary table into the ocean. Choke and kill line support clamps 60, 62 are located at two elevations on the pup joint 46. The bumpers 58 protect the equipment located on the pup joint 46 during running operations of the riser through the rotary table, and also provide a convenient means of supporting the heavier equipment and a convenient mounting surface for the control equipment. The pup joint 46 is equipped with conventional pin 63 and box 65 connections at opposite ends for connection to the riser string.

Flow to the subsea choke valve 44 is through the choke conduit line 40 or kill conduit line 42, one of the lines being designated as the active line, as indicated by the arrow 64 associated with the choke line 40. Flow through the choke line 40 is through the gate valve 48 which is connected in fluid communication with the choke line 40 in a tee coupling arrangement. Flow from the gate valve enters the choke 44 from which it is discharged through a spool which couples the choke to the discharge conduit 54. The discharge conduit is preferably a length of flexible rotary drill hose. Flow passes through the discharge conduit 54 through a coupler 66 to a large diameter discharge tube 68. Flow through the large diameter discharge tube 68 is directly into the annulus 34 of the riser.

The function of the gate valve 48 is to isolate the choke assembly 44 with respect to the choke or kill line pressure. The gate valve is preferably rated at least 10,000 psi service and is hydraulically actuated to open and fail safe closed with fail safe hydraulic pressure to assist closing. The gate valve 48 includes an integral tee which is flanged into the choke or kill line. The flanges are rated for at least 10,000 psi $H_2S$ service. The flow from the choke or kill line is directed horizontally towards the gate valve. The gate valve 48 is hydraulically opened with a fail safe operator 69. A pressure transducer 70 is connected to the gate valve 48 in the flow path of the inside of the gate valve.

The choke assembly 44 is remotely hydraulically actuated and contains a transducer responsive to the choke position for surface readout. The choke is hydraulically actuated by means of the actuator 52 at an opening and closing rate of three to five percent per second.

The subsea choke assembly 44 is controlled from an explosion-proof panel located on the drill floor of the drilling vessel 10. The control panel includes control switches and indicator lamps graphically arranged to display the status of the various pieces of subsea choke equipment mounted on the pup joint riser section 46. Communication between the surface and the subsea equipment is preferably by means of multiplexed BOP controls or by means of an auxiliary electro-hydraulic system.

A pair of hydraulic accumulators 72, 74 are supplied with pressurized hydraulic fluid through a hydraulic conduit 76 which is jumpered up from the BOP stack hydraulic supply. The hydraulic supply is manifolded and supplies both the gate valve 48 and the choke valve 44. Supply to either or both of the pod sections can be completely isolated. This function is carried out by an isolation assembly 78. This arrangement for controlling the opening and closing rate of the choke was designed to eliminate the use of a variable pressure regulator on the subsea choke 44. This permits the choke pod supply pressure to be set for the particular water depth to give a 3,000 psi differential operating pressure. To accomplish successful flow control of the fluid passing through the choke valve 44, there must be a pressure drop across the valve of approximately 3,000 psi less the pressure required to operate the choke.

The discharge conduit 54 is preferably a length of flexible drilling hose. For the pup joint shown in FIG. 3, the rotary hose is approximately 14 feet in length and has a 3½ inch inside diameter rated at 5,000 psi working pressure and 10,000 psi testing pressure. Because the outlet of the choke may be subject to large vibrations, and because of possible erosion caused by high velocity fluid discharged from the choke, the flexible rotary hose 54 is considered to be best suited for this application. At points where the hose makes contact with the bumpers, the hose is wrapped with layers of an abrasion resistant material 80. This protects the hose when the hose is vibrating as the choke is being used. The bumper 58 is preferably provided with an enlarged radius at the expected point of contact to insure that the hose does not ride on a sharp corner.

The flow path from the choke 44 to the riser annulus 34 is designed to be progressively increasing in diameter to reduce the velocity of the formation fluid or gas as much as possible before it enters the riser. In one preferred arrangement, the bore of the choke valve is 2 9/16 inches in diameter. The rotary hose is 3½ inches inside diameter and is coupled to the discharge tube 68 which has an inside diameter of 6 inches. Therefore, the flow path from the choke to the interior of the riser is progressively increasing in diameter thereby reducing the velocity of the fluid or gas as it is discharged prior to entering the riser. This serves to reduce vibration and erosion.

Figure 4:
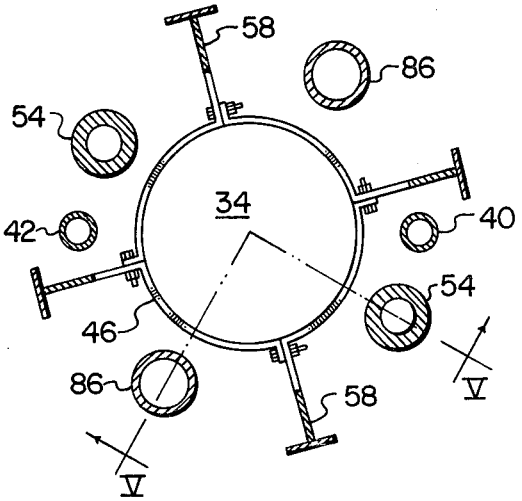
FIG. 4 is a sectional view taken along the lines IV—IV of FIG. 3.
Figure 5:
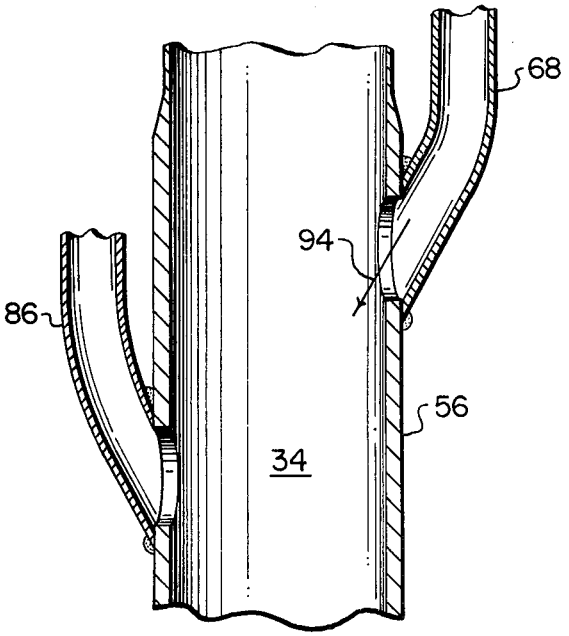
FIG. 5 is a sectional view taken along the lines V—V of FIG. 4.

Referring now to FIGS. 4 and 5, the relative location of the principal components is illustrated. As can best be seen in FIG. 4, the principal components are arranged in mirror image relation with respect to the center line of the riser.

Under certain conditions, a large volume of high pressure gas may be discharged in combination with other formation fluids through the choke conduit 40. When this occurs, a gas bubble is discharged into the annulus 34 of the riser 30 and expands as the drilling mud contained within the riser is displaced. It is possible that the drilling mud from the riser will be evacuated along a substantial length of the riser which can cause the riser to collapse because of the pressure differential. This condition may be corrected according to the invention by means of a pressure equalization valve assembly 82 which is connected in fluid communication with the interior of the riser. The pressure equalization valve assembly 82 may be opened by a hydraulic actuator to permit sea water to fill the voided annulus of the riser, thereby equalizing the pressure of the interior of the riser relative to the exterior of the riser. As can best be seen in FIGS. 3 and 5, the pressure equalization valve 82 is connected in fluid communication with the interior of the riser by means of a large diameter conduit 84. The opposite side of the pressure equalization valve 82 is connected to a large diameter conduit 86 which is terminated by an open dump port 88.

The pressure equalization valve 82 may optionally be used as a pressure equalization valve by allowing sea water to be discharged into the riser or as a dump valve by allowing what is inside the riser to escape or be discharged into the sea water. The pressure equalization valve 82 is remotely hydraulically operated. A flow indicator transducer 90 is connected to the flow path of the dump valve to provide a signal which indicates direction and flow rate. The pressure equalization valve is preferably of the ball valve type rated for at least 2,000 psi differential working pressure. The pressure equalization valve 82 is operated by means of a hydraulic actuator 92 which is set at 1,500 psi for system fail safe assist. The fail safe pressure acts upon the closed side of the actuator thereby giving an opening pressure of 1,500 psi differential between the open and closed pressures. The valve is either fully closed or fully opened in operation. One control function operates both pressure equalization valves on both sides of the pup joint to permit both pressure equalization valves to open at the same time. Removing the open pressure allows both valves to close at the same time. The closed pressure is supplied through the fail safe assist hydraulic circuit.

As can best be seen in FIG. 5, the discharge of formation fluid or gas through the large diameter discharge tube 68 is preferably at an acute angle relative to horizontal as indicated by the arrow 94. The interface of the large diameter discharge conduit 68 with the riser is preferably an eliptical opening as illustrated in FIG. 3. The large diameter conduit 86 which is connected to the pressure equalization valve 82 is also connected in an elliptical interface arrangement as shown in FIG. 5.

From the foregoing description of preferred embodiments of the invention, those skilled in the art will appreciate that the method and apparatus of the present invention provides for effective well control in relatively deep water offshore drilling operations. Because the subsea choke is located very close to the well head equipment, the pressure drop associated with the long choke conduit line is eliminated thereby permitting effective choke action without regard to the length of the choke and kill lines.

Although preferred embodiments of the invention have been described in detail, it should be understood that various changes, substitutions and alterations can be made therein without departing from the spirit and scope of the invention as defined by the appended claims.

What is claimed is:

1. A subsea choke and riser pressure equalization system comprising, in combination:

a section of riser pipe;

a choke conduit line mechanically supported by said riser pipe;

a variable choke valve having an inlet port and a discharge port;

a gate valve having an inlet port connected in fluid communiction with the choke line and an output port connected in fluid communication with the inlet port of the variable choke for permitting diversion of fluid from the choke line to the variable choke; and, means connecting the discharge port of the variable choke in fluid communication with the interior of the riser section, said means including a discharge conduit extending from said choke valve in inclined relation with respect to the axis of said riser, whereby fluid diverted from said choke conduit is discharged into said riser in counterflow relation with respect to the upward flow of drilling fluid through said riser.

2. In combination:

an offshore production facility including a drilling vessel stationed above an ocean floor production site in which well head equipment is embedded;

a marine riser connected to the well head equipment and extending from the well head equipment to the drilling vessel;

a drill string enclosed within said riser extending from said drilling vessel through the well head equipment and into a borehole beneath the ocean floor;

a choke conduit connected in fluid communication with the borehole and extending from the well head equipment to said drilling vessel;

a choke valve having an inlet port and a discharge port;

a gate valve connected in tee fluid circuit relation with said choke conduit and having an outlet port connected in fluid communication with the inlet port of said choke valve; and, a resilient discharge conduit connecting the outlet port of the choke valve in fluid communication with the interior of said marine riser.

3. In apparatus for drilling a well through a subterranean formation beneath the body of water from a surface vessel, said apparatus comprising a riser pipe which extends from said vessel to a subsea wellhead and a choke conduit line connected in parallel fluid circuit relation with the riser pipe intermediate the subsea well head and the surface vessel, the improvement comprising:

a surface controlled subsea choke valve mounted on the riser pipe near the subsea well head equipment, said choke valve having an inlet port and an outlet port; and, means connecting the inlet and outlet port of said choke valve in fluid communication with said choke line and the interior of said riser pipe, respectively, said connecting means including a resilient discharge conduit having a terminal section communicating with said riser in counterflow relation with respect to upward flow through said riser pipe.

4. Apparatus as defined in claim 3, the combination further including means for measuring the rate of fluid flow through said choke valve and for generating a surface detectable signal proportional to the measured rate of fluid flow, and surface means responsive to said signal for controlling the rate of flow through said control valve.

5. A riser mounted, surface controllable subsea choke valve assembly comprising:

a riser pup joint having pin and box connections at opposite ends for connection to a riser string;

a section of choke conduit line mounted on said riser pup joint;

a surface controllable choke valve having an inlet port and a discharge port; and, means connecting the inlet and discharge ports of said choke valve in fluid communication with the choke conduit line and the interior of said riser pup joint, respectively, for permitting diversion of fluid from said choke conduit line into said riser pup joint.

6. The subsea choke valve assembly as defined in claim 5, said connecting means including a gate valve connected in tee fluid circuit relation with said choke conduit line and having an outlet port connected in fluid communication with the inlet port of said choke valve.

7. The subsea choke valve assembly as defined in claim 5, said connecting means including a discharge conduit connecting the outlet port of the choke valve in fluid communication with the interior of said riser pup joint, the flow path defined by said discharge conduit having a cross-sectional area which increases from the choke valve to the riser pup joint.

8. The subsea choke valve assembly as defined in claim 5, said connecting means including a discharge conduit connecting the outlet port of said choke valve in fluid communication with the interior of said riser, said discharge conduit having a terminal section communicating with said riser and defining a discharge flow path which is inclined at an acute angle with respect to the axis of said riser, whereby fluid diverted from said choke conduit line through said choke valve is discharged into said riser in a direction which opposes the upward flow of drilling fluid through said riser.

9. The subsea choke valve assembly as defined in claim 5, said connecting means including a plurality of bumper guards attached to said riser, said bumper guards extending along the length of said riser and projecting radially with respect to the exterior surface of said riser, said choke valve and choke conduit line being disposed radially inward with respect to the outermost edge of said bumper guards.

10. The subsea choke valve assembly as defined in claim 5, said connecting means including a surface controllable pressure equalization valve assembly mounted on said riser section and connected in fluid communication with the interior of said riser, said pressure equalization valve having an open position for permitting sea water to be admitted into the riser, or for permitting drilling fluid inside of the riser to be discharged from the riser into the surrounding sea water.

11. The subsea choke valve assembly as defined in claim 5, said connecting means including a discharge conduit connecting the outlet port of said choke valve in fluid communication with the interior of said riser, said discharge conduit comprising a length of resilient conduit.

12. The subsea choke valve assembly as defined in claim 11, said length of resilient conduit comprising a length of flexible rotary drill hose.

13. In a method of drilling a well in a subterranean formation beneath a body of water from a floating surface vessel wherein a drill string passes through a riser pipe which extends from said vessel to a subsea well head and then through a borehole under the body of water and wherein a drilling fluid is introduced into said drill string and is returned through the annulus between said drill string and said riser pipe, and wherein a choke conduit line is connected in fluid communication with said borehole and extends to said surface vessel for relieving the pressure exerted by gases and fluids of the subterranean formation, the improvement comprising the following steps:

monitoring the down hole pressure of the subterranean fluid;

opening a surface controllable valve positioned near the bottom of said riser pipe to selectively divert the gas and formation fluids conveyed through the choke conduit into the annulus of said riser pipe in counterflow relation with respect to return flow of said drilling fluid whenever the pressure exerted by the subterranean fluids exceeds a predetermined level; and varying the closure rate of said choke valve to maintain the down hole pressure exerted by the gases and fluids of the subterranean formation substantially in equilibrium with the hydrostatic head of the column of drilling fluid contained within the riser annulus.

14. The method as defined in claim 13, wherein the step of diverting fluid from said choke line through said choke and into said riser is carried out by discharging the fluid from said choke assembly through a fluid flow path which generally increases in cross sectional area from said choke valve to the interface of said fluid flow path with said riser.

15. The method as defined in claim 13 including the step of discharging said fluid from said choke valve through a discharge conduit into the riser annulus at an acute angle with respect to the axis of said annulus whereby fluid discharged along said flow path opposes the upward flow of drilling fluid through said riser.

16. The method as defined in claim 13, including the step of conveying fluid discharged from said choke through a resilient conduit prior to discharging the fluid into said riser annulus.

* * * * *